United States Patent [19]

Faltin

[11] 4,405,122

[45] Sep. 20, 1983

[54] HIGH SPEED FEEDING AND TRANSPORT OF PAPER SHEET PRODUCTS

[76] Inventor: Hans G. Faltin, 4135 Wilshire Dr., York, Pa. 17402

[21] Appl. No.: 270,827

[22] Filed: Jun. 5, 1981

[51] Int. Cl.[3] ..... B65H 5/10

[52] U.S. Cl. ..... 271/8 A; 271/12; 271/91; 271/100; 271/106; 271/107; 271/277

[58] Field of Search ..... 271/11, 12, 13, 8 A, 271/91, 100, 101, 106, 107, 268, 277, 315

[56] References Cited

U.S. PATENT DOCUMENTS

| | | | |
|---|---|---|---|
| Re. 21,489 | 6/1940 | Kleinberg | 271/8 A |
| 1,292,641 | 1/1919 | Pedrick | 271/8 A |
| 1,504,862 | 8/1924 | Brooks | 271/101 |
| 2,304,172 | 12/1942 | Heywood | 271/8 A |
| 3,385,594 | 5/1968 | Preisig | 271/101 X |
| 3,650,525 | 3/1972 | Hageman | 271/101 |
| 4,127,262 | 11/1978 | Eberle | 271/12 |

*Primary Examiner*—Richard A. Schacher
*Attorney, Agent, or Firm*—Laurence R. Brown

[57] ABSTRACT

A single paper sheet product separator, feeder and transport mechanism is provided capable of high speed in line product feed rates from a stack of products of 60,000 per hour for on-line operations with high speed rotary presses, trimmers, binding machines, folders, etc. By initially bending only a bottom edge of the product stacked on edge, reliable high speed separation is feasible. A scalloped periphery rotary member provides indentations for precisely seating and spacing the individual documents and grasping them to pull them substantially horizontally from the stack, in shingled array if desired. The products are retained against the rotary member by a moving belt over an arc of substantially 180° to be discharged substantially horizontally onto a conveyor belt for further transport.

15 Claims, 5 Drawing Figures

HIGH SPEED FEEDING AND TRANSPORT OF PAPER SHEET PRODUCTS

TECHNICAL FIELD

This invention relates to the feeding and transport of paper sheet products and more particularly it relates to the segregation of individual paper products from a stack at very high processing rates.

BACKGROUND ART

In general, the prior art feeding and transport systems for isolating and feeding individual paper sheet products from a stack are of the bottom, side or top feeding class. Present devices in general limit the store of documents in the stack because of the considerable variations in the friction induced by dragging a single product against the weight of the stack.

Also such feeding techniques in most cases have the disadvantage of necessitating one product to be fully withdrawn from the stack before a succeeding document may be processed, thus limiting flexibility and speed.

Other devices have the shortcoming of losing control over timing and/or positioning of products being withdrawn from a stack so that later re-timing becomes necessary with use of the withdrawn products in synchronous or closely timed processing equipment.

Typical maximum processing speeds of prior art processing equipment gripping one product at a time is about 12,000 pieces per hour. However, any such equipment cannot be used on-line with high speed equipment capable of processing 40 to 60,000 pieces per hour, unless paralleled.

Further deficiencies of the prior art equipment include (1) complex equipment expensive to purchase and maintain, (2) lack of precision in timing of documents for synchronous operation in on-line operations, and (3) the use of considerable space for the feeding equipment.

Accordingly, it is an objective of this invention to improve the state of the art, to correct the foregoing problems of the art, and to provide high speed feeding equipment capable of on-line or off-line use with high speed rotary presses, or other high speed equipment.

BRIEF DISCLOSURE OF THE INVENTION

Thus, in accordance with this invention there is provided high speed feeding and transport methods and apparatus capable of separating from a stack individual paper sheet products at speeds of 40,000 to 60,000 pieces per hour. The equipment may, for example, be used to feed separate pre-printed signatures into an on-line system operating at press speeds with such precision spacing, speed and orientation that the signatures can feed directly into the on-line processing equipment.

The paper sheet products of one or many sheets are stacked on edge in a substantially vertical position against a roller stop in any quantity. The foremost sheet is bent away from the stack at the bottom, seated against an indentation in a scalloped periphery rotating member such as disc or drum for precise spacing and grasped for pulling from the stack. A sequential sheet product is bent away from the stack as each preceding product is being located and pulled out substantially horizontally from the stack so that the products are handled in a shingled array thus further increasing speed and reducing friction.

The separated products are carried about an arc of substantially 180° on the rotating member for release as they attain a substantially horizontal position at the bottom of the rotating member. During this arc travel distance, the shingled documents are held against the periphery of the rotating member by a flexible belt travelling at the same speed as the periphery in a path adjacent the carriage arc. The products are then discharged upon a conveyor belt in shingled timed array for further transport and use elsewhere.

Further features, objects and advantages of the invention are found throughout the following description, drawing and claims.

THE PREFERRED EMBODIMENT OF THE INVENTION

Figure 1:
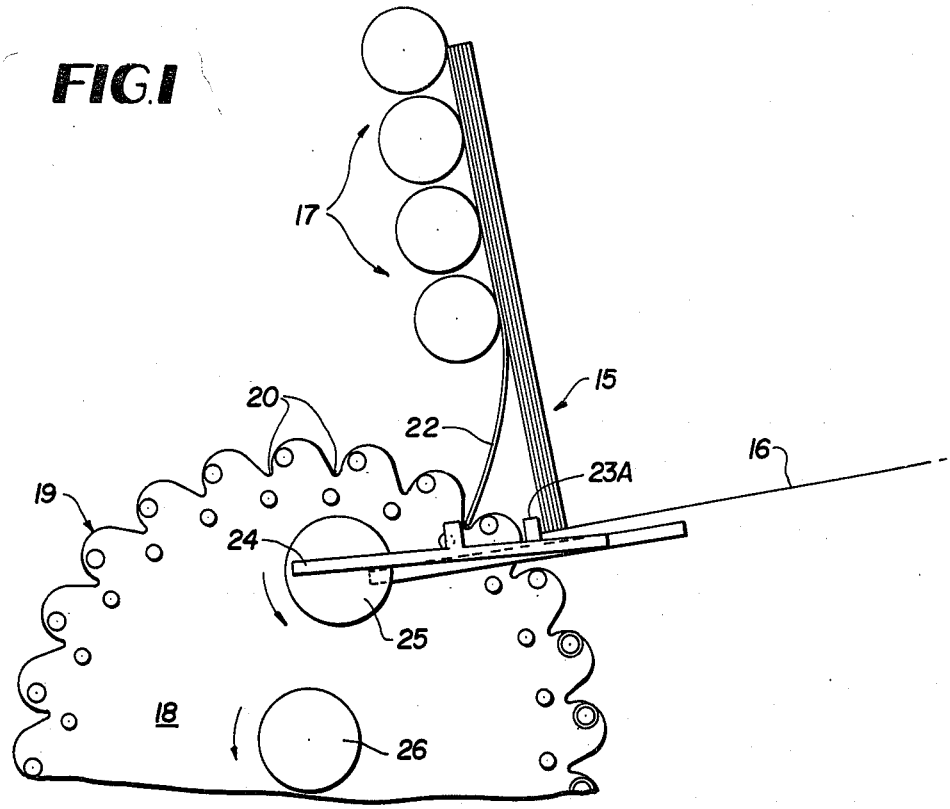
FIG. 1 is a partial side view of a paper sheet product feed mechanism for removing the products individually from a stack showing the initial phase of the separation procedure.

There are many factors that have prevented prior systems from achieving precise speed and spacing at very high speeds such as 60,000 pieces per hour in the feeding of individual paper sheet products separated from a stack. Because of the high initial inertia and frictional drag against the stack when moving an entire product such as a 48 page signature, very heavy and cumbersome equipment has been customary. However, as seen in FIG. 1, simple, reliable and inexpensive equipment is provided by this invention which operates on a different feeding principle.

Thus, the paper sheet products 15 are stacked on edge on a tray 16 which is slightly inclined from horizontal to hold the products substantially vertically. For multiple sheet products, the fold is at the bottom. The product stop comprises a set of rollers 17, which reduce the withdrawal friction as the products are pulled off the stack. The stack can be unlimited in the number of documents and can be received from a feeder mechanism, by placing in bundles or by manual loading. Preferably a constant feed force is applied at the rear of the stack by appropriate means (not shown) to keep the sheet paper products firmly against the stop rollers 17 with a predetermined force. The downward feed incline of the ramp or tray 16 aids the feed of documents toward the stop rollers 17.

The rotating member 18 is provided with a scalloped circumferential periphery 19 having precisely spaced indentations 20 for receiving in seated registration the successive papers 22 being fed from the "bottom" of stack 15. Thus, the initial separation inertia is very low because only the bottom edge of the product need be moved with negligible friction and much less weight than the entire product. Also the distance the products are moved is small, the speed of the products being moved is small, the products are moved in a pattern that does not interfere with moving vacuum grippers or the like and the product grippers grasping the products after separation cam work gradually instead of instantaneously and at lower acceleration speeds. Thus, a high speed reliable separation of individual products is feasible by means of a suction member 23 on the reciprocating arm 24 which is synchronously phased with rotation of the rotating member 18 to deposit the product 22 into the indentations of the scalloped periphery, which in this case has just been done. Thus, rotating camshaft 25 appropriately reciprocates the bending member which preferably is a suction member being fed synchronously with a suction to pick up and release each document as the member 23 reciprocates.

To even further increase separating and processing speeds for handling the paper sheet products 22 from stack 15, two bending members are reciprocated in appropriate phase by cam wheel 25 so that the alternate bending suction member 23 engages and starts to bend a subsequent sequential paper sheet product before the former suction member could release the former product and return, as seen from suction member 23A. Clearly the bending means 23–25 is a low inertia mechanism that need not be operable at very high speeds. Preferably the rotating member 18 comprises a set of discs, as seen better from FIG. 5, which permits the cam 25, suction arm 24 and like control mechanisms to be appropriately mounted on or between discs and along and about the disc rotating shaft 26. It is significant that the movement pattern of the paper products and the short distance between shingled products prevents interference of the separating members and short movement paths simplifying operation and improving reliability.

Figure 2:
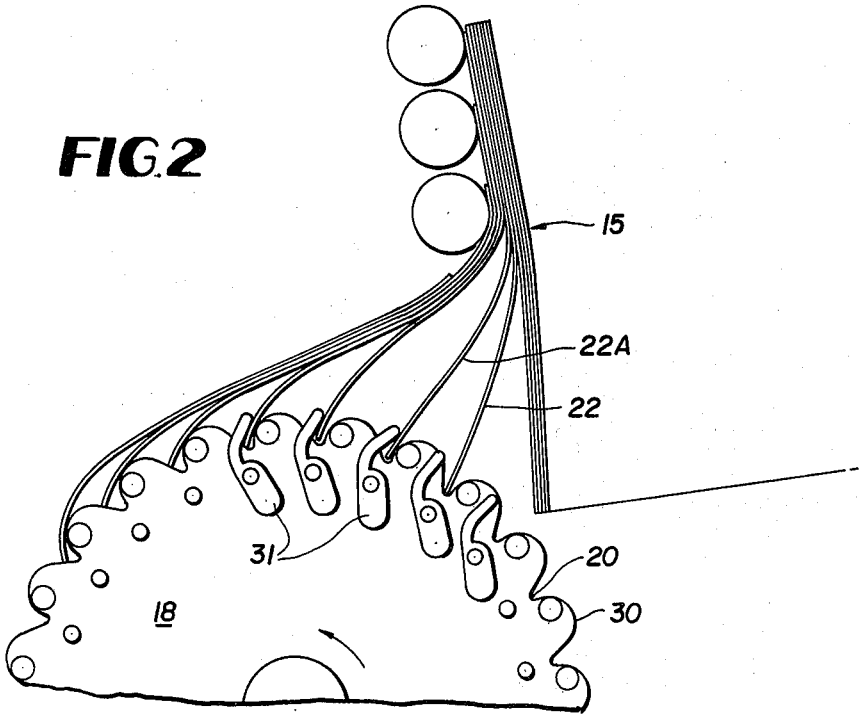
FIG. 2 is a similar partial side view of the same mechanism showing the simultaneous processing of a plurality of single paper sheet products in a shingled array with precise timing and spacing.

As better seen from FIG. 2, the rotary member 18 processes a plurality of individual paper sheet products 22, 22A, etc. simultaneously. The rotating member 18 with the scallops 30 and indentations 20, while rotating counterclockwise as shown, tend to seat the individual products firmly and precisely at known locations, the bottom of the successive indentations. This delivers the individual sheet paper products with precise control over spacing and timing frequency. The rotating member 18 may rotate at an appropriate speed for synchronization with an on-line system (not shown) into which the products are fed.

This invention gives the significant advantage of permitting a low speed rotating wheel assembly to grasp firmly each sequential paper product by means of a clamp mechanism 31 and pull it from the stack 15 against the roller and adjacent product. Thus, a scalloped wheel having twenty-four scallops spaced at about 15 inches need only rotate at 2500 RP hour to process 60,000 pieces per hour. Clearly this compared with 60,000 RPM which would be otherwise necessary to permit the product processing rate, affords much more reliable and precise operation of the equipment. Other advantages include low energy, etc. This permits cams 31 to move relatively slowly into place gradually instead of instantaneously grasping and yanking an entire product at high rotation and surface speed. Also, the product is resident in the slot 20 and need not even be moved by the clamp 31 when grasped, and when eventually moved is moved at low scallop wheel speeds with very low comparative acceleration. Thus, the invention provides a gripping action which gives very high effective piece by piece processing speeds with the time the gripper has to act prolonged and with the products being gradually speeded up over only a couple of inches of travel rather than over an entire document length. Several products are simultaneously being processed in shingled array thereby causing the relative movement gaps to be small and the overall single product rate to be high. It is seen from the removal pattern that the products as they are diverted in direction from substantially vertical storage position to substantially horizontal withdrawal direction tangential to the rotating member 18 have quite shortened frictional paths adjacent the products on either side with a foreshortened travel distance when the weight of the stack 15 presses the documents together. Thus, friction is minimized. Also, since each of the successive products is moving, only the total distance between adjacent indentations 20 is the total net frictional overlap distance when the products are delivered in a shingled array as shown.

Figure 3:
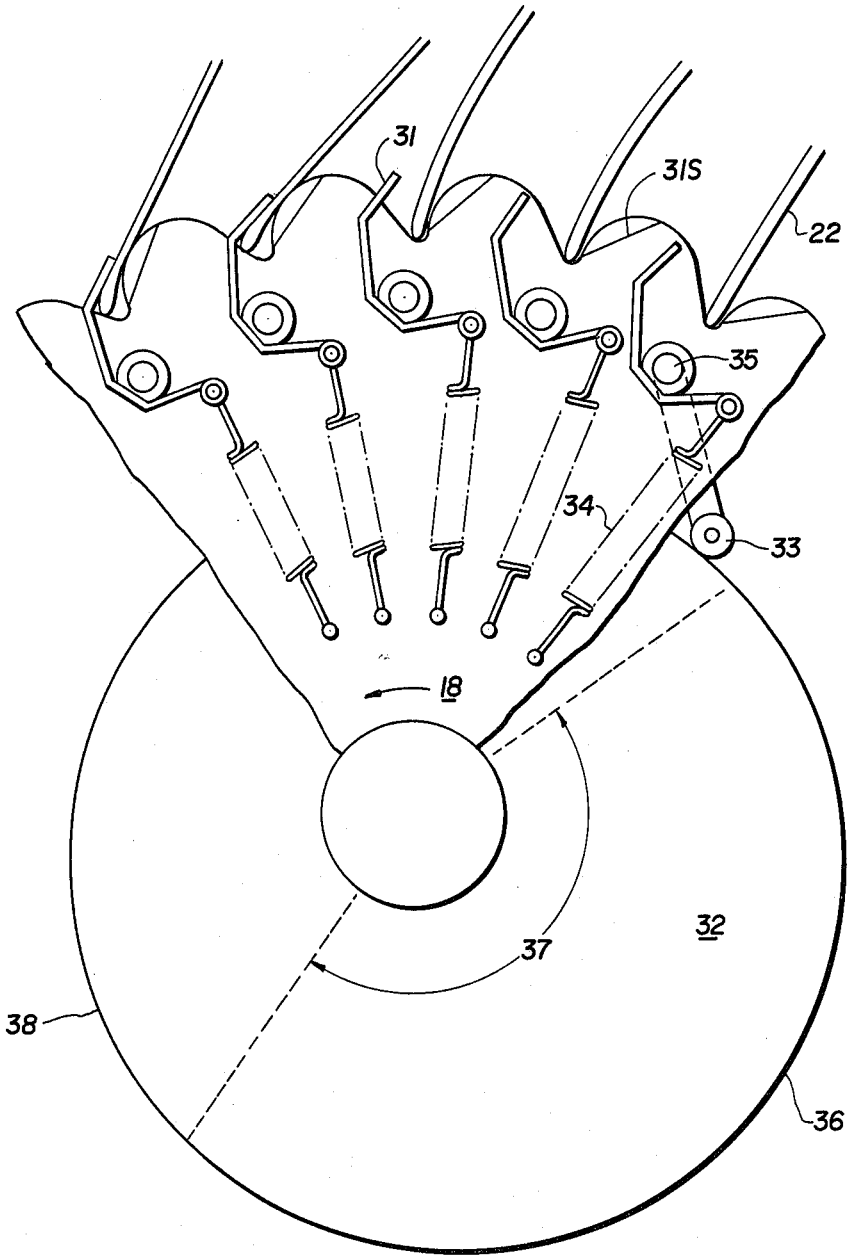
FIG. 3 is a detailed partial side view, partly broken away, to illustrate the paper product grasping clamp camming operation.

As seen from FIG. 3, one simple mechanism for operating the clamps 31 comprises the fixed cam wheel 32, about which rotating member 18 rotates. It is seen that the cam roller 33 is held against the cam wheel 32 by means of a spring 34 as clamp 31 is pivoted about shaft 35 into stops 35S. Thus, over the outer full radial periphery 36 of cam wheel 32 over the arc 37, the clamp member will be open to receive the paper sheet products into the indentations 20 as shown by sheet product 22 in FIG. 2.

However, over the remainder of the arc of rotation (substantially 180°) of rotating member 18, the clamp is moved into clamping position for retaining the sheet product in place for transport about the rotating member periphery, and is moved into release position as the sheet product nears a position to be released for horizontal conveyance near the bottom of the rotating member 18 periphery. Several successive typical clamp postures are shown to correspond with the grasping feature of FIG. 2. It is evident that the release of the grasp on the paper sheet product takes place by means of the shouldered contour 3 of the cam surface.

Figure 4:
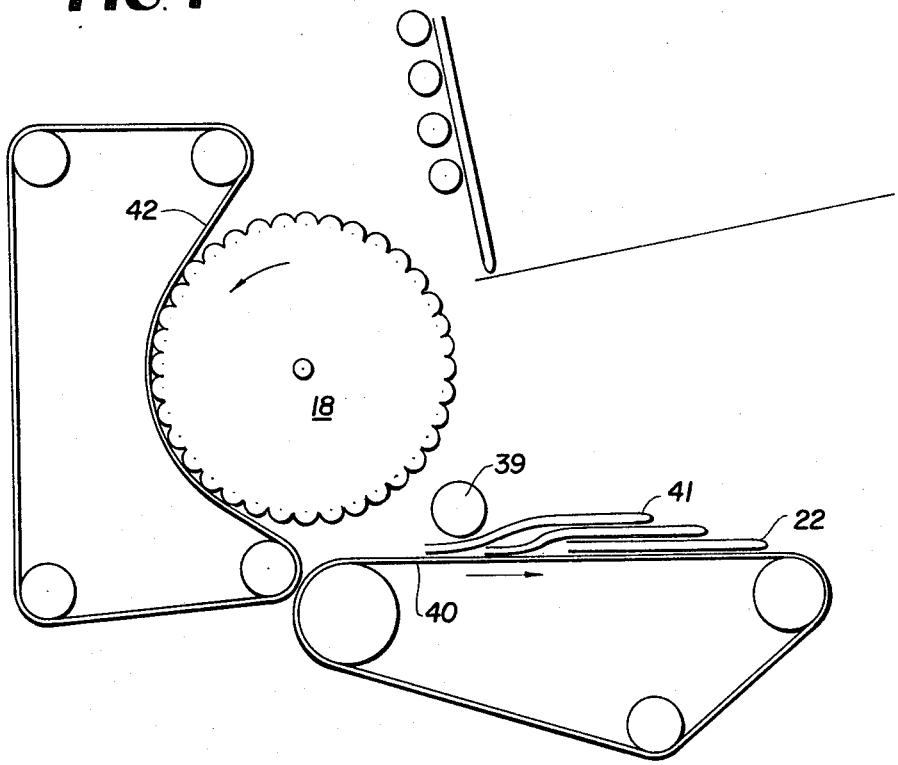
FIG. 4 is a side view of the feeding-transport system afforded by this invention, omitting the feeding system of FIGS. 1 to 3 for clarity.

As may be seen from the system view of FIG. 4, the paper sheet products in shingled form are carried about the peripheral circumference of the rotating member 18 and discharged typically on the horizontally disposed conveyor belt 40 in precisely spaced shingled array 41. However, the orientation may be changed.

As the products rotate about the arc of travel of rotary member 18 they, of course, are carefully and precisely controlled in speed such as at 90 inches per minute product surface speed with products spaced at $1\frac{1}{2}$ inches and are confined by the flexible belt 42 moving at the same speed as the circumferential periphery of the rotating member 18. The accelerating roller 39 then can speed up the movement on conveyor belt 40 to unshingle or separate the products further and further gradual speed changes may be used, thus permitting the use of single unshingled products. Thus, at 60,000 products per hour, or 1,000 products per minute you start with a surface speed of 55 feet per minute and through successive speed ups the product (12" long) becomes unshingled and travels at 1,000 feet per minute. It may be seen therefore that the feeder transport mechanism is most simple and takes up little room. The equipment is inexpensive and easily maintained, yet operates with improved precision control of document spacing and speed over higher speed ranges than heretofore successfully attained with reliable precision equipment.

Figure 5:
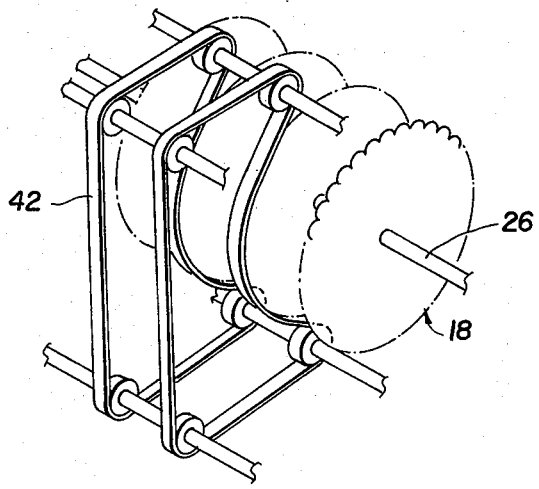
FIG. 5 is a perspective partial view showing the left hand in elevation of the rotating assembly of the FIG. 4 system.

The perspective view of FIG. 5 further shows the simplicity of the multiple disc rotating member 18 and belt array 42. In this array the clamps are arranged only on the two mid-section discs.

It is clear therefore that this advance in the art is a patentable improvement and those novel features believed descriptive of the spirit and nature of the invention are set forth with particularity in the claims.

INDUSTRIAL APPLICATION

A high speed paper sheet product separator-feeder-conveyor system is provided for such operations as feeding signatures of one or more pages into printed newspapers from a stack of unlimited thickness at on-line high speed rotary press speeds in precisely oriented timed and spaced array for direct feed to further inserting or processing equipment. The system can be used advantageously for other paper sheet product feeding from a stack for synchronous on-line use in other equipment requiring precise product speed and separation.

I claim:

1. The method of feeding and transporting paper sheet products comprising the steps of, stacking the paper sheet products against a stop to form a stack, bending away from the stack individually one at a time one edge of a sequence of single paper sheet products held in place by the stop, seating firmly a plurality of the products in the stack against said stop against a metered gage separating a plurality of sequential products a predetermined distance, grasping the edge of the single paper sheet product when bent away from the stack and seated in the gage, and pulling a plurality of the grasped paper sheet products from the stack in a substantially shingled array for transport away from the stack.

2. The method defined in claim 1 including the step of providing a set of spaced rollers at the stop confronting said plurality of said seated paper sheet products in the stack thereby to reduce friction as the paper sheet products are pulled from the stack, to thereby permit removal of the product from the stack at speeds up to 60,000 per hour.

3. The method defined in claim 1 wherein the sheets are stacked substantially vertically on edge, and are disposed to rest against said stop so that the friction of sheet upon sheet as the sheets are pulled from the stack is at a substantially constant low level without the weight of a stack of sheets contributing to said friction.

4. The method defined in claim 1 including the step of registering and clamping a plurality of successive sheets in gage means comprising scalloped indentations of a rotating wheel each having a grasping clamp thereby to grasp and pull a plurality of products from the stack in a shingled array thereby presenting less overall sheet to sheet frictional surface contact while presenting precisely spaced sheet separation, whereby a product processing speed of up to 60,000 per hour may be realized.

5. The method defined in claim 4 wherein the sheets are folded to present the folded edge for bending away from said stack and including the more restricted step of grasping the products at a leading folded edge in said clamps.

6. The method defined in claim 1 including the step of separating the single paper products by a precisely defined separation distance in a shingled array by introducing each sequential single paper product into a gage comprising a separate indentation on the circumferential scalloped periphery of said rotating member each having a clamp operable for each indentation to grasp and pull the product from the stack.

7. The method defined in claim 6 including the steps of holding each single product at a fixed spacing for rotation with said member about a predetermined arc retaining the spaced products on the periphery by a belt moving adjacent with said periphery, and releasing the products from the clamps in shingled position between the belt and periphery for transport in shingled array with precisely spaced distances between sequential products.

8. The method defined in claim 1 including the step of grasping the sequence of single products in a shingled array by a sequence of clamping means located about the periphery of a rotating member comprising said gage.

9. The method defined in claim 8 including the step of seating sequential ones of the single products in gage means comprising scalloped indentations on the periphery of said rotating member to produce initial bending of the edges away from the stop before the sheets are grasped in said clamps.

10. A feeding and transporting system for paper products comprising in combination, means for stacking the paper sheet products against a stop to form a stack, means for bending away from the stack simultaneously an edge of several single paper sheet products held in the stack by the stop, rotary gaging means with precisely spaced peripheral clamps close enough together for grasping the lower edge of a sequence of the single paper sheet products when bent away from the stack and resting against said stop thereby comprising means for pulling a shingled array of the grasped paper sheet products from the stack in a desired direction for transport away from the stack with precisely defined distances between successive documents.

11. The system defined in claim 10 wherein the gaging means further comprise means for separating the single paper sheet products by a precisely defined separation distance in the shingled array by means of a scalloped circumferential periphery on the rotary means receiving each sequential single paper sheet product into a separate indentation before clamping it there in place.

12. The system defined in claim 11 further comprising means for releasing the single paper sheet products from the rotating member in sequence while retaining said precisely spaced shingled array against the rotary means periphery as the rotating means presents the shingled products in a desired transport direction.

13. The system defined in claim 12 further comprising means for transporting the shingled array of precisely spaced paper sheet products away from the rotary member on a horizontally disposed conveyor belt timed to receive the products released from said rotary means.

14. The system defined in claim 11 further comprising means for holding the paper products in shingled form against the periphery of the rotating member over a predetermined arc and means for releasing said paper sheets from the clamps while being so held.

15. The system defined in claim 14 wherein the means for holding the products against the rotating member comprises a flexible rotating belt disposed adjacent said periphery about said arc.

* * * * *